US005236885A

United States Patent [19]

Tanimoto

[11] Patent Number: 5,236,885

[45] Date of Patent: Aug. 17, 1993

[54] SHEETS FOR TAKING PRINTS AND A METHOD OF TAKING PRINTS

[75] Inventor: Tadashi Tanimoto, Amagasaki, Japan

[73] Assignee: Kanzaki Paper Manufacturing Co., Ltd., Japan

[21] Appl. No.: 799,097

[22] Filed: Nov. 27, 1991

[30] Foreign Application Priority Data

Nov. 29, 1990 [JP] Japan ..... 2-337160

[51] Int. Cl.[5] ..... B41M 5/128

[52] U.S. Cl. ..... 503/201; 503/205; 503/206

[58] Field of Search ..... 503/201, 205, 206

[56] References Cited

U.S. PATENT DOCUMENTS 4,101,690 7/1978 Miyamoto et al. ..... 428/195
4,170,483 10/1979 Shackle et al. ..... 428/537
4,232,083 11/1980 Buerkley et al. ..... 503/206

FOREIGN PATENT DOCUMENTS 54-44706 11/1976 Japan ..... 503/201

OTHER PUBLICATIONS

Derwent publication of JP Kokai 63-242677 published in the United Kingdom in Oct., 1988.

*Primary Examiner*—Pamela R. Schwartz
*Attorney, Agent, or Firm*—Larson & Taylor

[57] ABSTRACT

Disclosed are a sheet for taking a print of an object, the sheet comprising (a) a substrate, and (b) a coating layer formed over the whole surface or part of the surface of the substrate and comprising a colorless or pale-colored basic dye, a color developing material which develops a color on contact with the dye and an adhesive, the whole of the coating layer being colored by the color-forming reaction of the basic dye and the color developing material; a method of taking a print of an object with use of the sheet comprising applying a desensitizer to the object and contacting the desensitizer with the sheet; and a kit for this purpose comprising the sheet and a desensitizer.

6 Claims, No Drawings

SHEETS FOR TAKING PRINTS AND A METHOD OF TAKING PRINTS

BACKGROUND OF THE INVENTION

1. Field of the Invention

The present invention relates to a sheet on which a hand print, a footprint or prints of other objects can be easily produced and a method of taking a hand print or the like using the sheet.

2. Prior Art

Hand prints or footprints have been used to investigate the growth process of hands or feet for medical purpose. Especially footprints have been frequently used as expedient means for examining a flatfoot in a screening method or for measuring the size of sole in making shoes or boots on order. It is well known to take a hand print or a footprint by applying a coloring material to the palm or sole to be imprinted and impressing the palm or sole on paper or like substrate. This method, however, entails difficulty in removing the coloring material from the palm or sole after impression. Therefore it is desired to improve the method.

SUMMARY OF THE INVENTION

It is an object of the present invention to provide a method for taking a hand print, a footprint or prints of other objects, the method being capable of easily producing such prints without staining the palm, sole or other objects with a coloring material.

According to the present invention, there is provided a sheet for taking a print of an object, the sheet comprising:

(a) a substrate, and (b) a coating layer formed over the whole surface or part of the surface of the substrate and comprising a colorless or pale-colored basic dye, a color developing material which develops a color on contact with the dye and an adhesive, the whole coating layer being colored by the color-forming reaction of the basic dye and the color developing material.

According to the present invention, there is also provided a method for taking a print of an object using said sheet, the method comprising the steps of applying a desensitizer to the object and bringing the applied desensitizer into contact with a colored portion of the sheet, the sheet comprising:

(a) a substrate, and (b) a coating layer formed over the whole surface or part of the surface of the substrate and comprising a colorless or pale-colored basic dye, a color developing material which develops a color on contact with the dye and an adhesive, the whole coating layer being colored by the color-forming reaction of the basic dye and the color developing material.

I conducted research using a sheet which comprises a substrate and a coating layer formed over the substrate and comprising a colorless or pale colored basic dye, a color developing material which develops a color on contact with the dye and an adhesive, the coating layer being wholly colored by causing the color-forming reaction of the basic dye and the color developing material. My research revealed that when a specific desensitizer is brought into contact with the colored portion of the sheet, the colored portion is decolorized. I continued the research on the basis of this finding and found that when a desensitizer is applied to the surface of the palm, the sole or like objects to be imprinted, and then the desensitizer is contacted with the colored portion of the sheet, the colored portion is decolorized, thereby giving a desired print. The sheet of the invention as defined above will be hereinafter referred to as "printing sheet".

According to the foregoing method, a hand print, a footprint or prints of other objects can be taken without smearing the surface of the palm, sole or object with a coloring material. However, the desensitizer may sometimes remain on the surface of the palm, sole or object after impression, giving an unpleasant feeling. The remaining desensitizer can be easily removed by washing with water. When the printing sheet is used to conduct a group examination for medical study of feet or to measure the sole size in the shoe industry, it is desired to avoid the need for washing the desensitizer with water and to avoid unpleasant feeling on the part of persons taking their footprint.

From this viewpoint, the present inventor further continued the research and found that if the coating layer of the printing sheet further contains a specific pigment, the desensitizer would be unlikely to remain on the surface of the palm, sole or object.

The present invention has been accomplished on the basis of this novel finding.

DESCRIPTION OF THE INVENTION

Colorless or pale-colored basic dyes which can be used in the invention include various basic dyes conventionally used in the art of heat-sensitive recording materials or pressure-sensitive recording materials. Examples of such basic dyes are 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol3-yl)phthalide, 3-(p-dimethylaminophenyl)-3-(2-methylindo-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, 3-[4-(diethylamino)-2-ethoxyphenyl]-3-(2-methyl-1-octyl-3-indolyl)-4-azaphthalide, 3,3-bis(2-methyl-1-octyl-3-indolyl)-4-azaphthalide and like triarylmethane-based dyes; 4,4'-bis-dimethylaminobenzhydryl benzyl ether, N-halophenylleuooauramine, N-2,4,5-trichlorophenyl-leucoauramine and like diphenylmethane-based dyes; benzoylleucomethylene blue, p-nitrobenzoyl-leucomethylene blue and like thiazinebased dyes; 3-methyl-spiro-dinaphthopyrane, 3-ethyl-spirodinaphthopyrane, 3-phenylspiro-dinaphthopyrane, 3-benzylspiro-dinaphthopyrane, 3-methyl-naphtho-(6'methoxybenzo)spiropyrane, 3-propyl-spiro-dibenzopyrane and like spiro-based dyes; rhodamine-B-anilinolactam, rhodamine(p-nitroanilino) lactam, rhodamine(o-chloroanilino)lactam and like lactam-based dyes; 3- dimethylamino-7-methoxyfluoran, 3-diethylamino-6-methoxyfluoran, 3-diethylamino-7-methoxyfluoran, 3- diethylamino-7-chlorofluoran, 3-diethylamino-6-methyl-7- chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-(N-methylamino)fluoran, 3-diethylamino-7-dibenzylamino-fluoran, 3-diethylamino-7-(N-methyl-N-benzylamino)-fluoran, 3-diethylamino-7-(N-chloroethyl-N-methylamino)fluoran, 3- diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-cyclohexyl-N-methylamino)-6- methyl-7-phenylaminofluoran, 3-pyrrolidino-6-methyl-7phenylaminofluoran, 3-piperidino-6-methyl-7-phenylaminofluoran, 3-diethylamino-6-methyl-7-(2,4-dimethylphenylamino)fluoran, 3-diethylamino-7-(o-chlorophenylamino)fluoran, 3-dibutylamino-7-(o-chlorophenylamino)fluoran, 3-pyrrolidino-6-methyl-7-(p-butylphenylamino)fluoran, 3-(N-methyl-N-n-amylamino)-6-methyl-7-phenylaminofluoran, 3-(N-ethyl-N-n-amylamino)-6-methyl-7-phenylaminofluoran, 3-(N-ethyl-N-isoamylamino)-6-methyl-7-phenylaminofluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-β-ethylhexylamino)-6-methyl-7-phenylaminofluoran and like fluoran-based dyes; etc. The basic dyes useful in the invention are not limited to the examples given above. The dyes can be used singly or at least two of them are usable in mixture.

The color developing materials which are used in combination with the above basic dye in the invention include those conventionally used in the art of heat-sensitive recording materials or pressure-sensitive recording materials. Specific examples of color developing materials are phenolic compounds such as 4-tert-butyl phenol, α-naphthol, β-naphthol, 4-acetylphenol, 4-tert-octylphenol, 4,4'-sec-butylidenediphenol, 4-phenylphenol, 4,4'-dihydroxydiphenylmethane, 4,4'-isopropylidenediphenol, hydroquinone, 4,4'-cyclohexylidenediphenol, 4,4'-dihydroxydiphenylsulfide, 4,4'-thiobis-(6-tert-butyl-3-methylphenol), 4,4'-dihydroxydiphenylsulfone, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenolic polymer and like phenolic compounds; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)-salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di(α-methylbenzyl)-salicylic acid and the like; salts of the above-exemplified aromatic carboxylic acids with polyvalent metals such as zinc, magnesium, aluminum, calcium, titanium, manganese, tin, nickel and like organic acidic substances. These color developing materials can be used singly or at least two of them are usable in mixture.

The proportions of the basic dye and the color developing material to be used in the invention can be suitably determined without specific limitation. Generally the color developing material is used in an amount of about 100 to about 700 parts by weight, preferably about 150 to about 500 parts by weight, per 100 parts by weight of the basic dye.

When required, the specific pigment may be incorporated into the coating layer of the printing sheet as described above to prevent the desensitizer from remaining on the surface of palm, sole or object. Examples of useful pigments are those which are at least 50 ml/100 g, preferably about 55 to about 200 ml/100 g, in the oil absorption according to JIS K-5101, and include, for example, calcined clay, diatomaceous earth, anhydrous silica, white carbon, magnesium aluminosilicate, calcium carbonate, magnesium carbonate, etc. Since the oil absorption of pigments can be varied depending on the shape and particle size of pigment particles or other factors, even the pigments with an oil absorption below the above range can be used if physically or chemically treated to increase the oil absorption to 50 ml/100 g or more, preferably about 55 to about 200 ml/100 g. The use of pigments having an oil absorption of less than 50 ml/100 g tends to produce insufficient effects, whereas the use of pigments having an oil absorption of more than 200 ml/100 g is likely to give obscure image. There is not a specific restriction on the particle size of the pigment. However, it is preferable to use a pigment having an average particle size, of about 0.1 to about 10 μm.

Determination of oil absorption according to JIS K 5101 is as follows:

From one to give grams of the sample shall be placed on a glass plate (about 250×250×5 mm). Adequate amount of the boiled linseed oil shall be dropped from a burette in small quantities on the center of the sample and kneaded thoroughly with a steel spatula.

Both the gripping and kneading operation shall be continued until the stiff putty-like conditioned conglomerates of oil and pigment as a whole have been formed, and the developed stuff may be rolled up in spiral shape with a steel spatula. The addition of oil having been ceased at this stage, the total amount of the boiled linseed oil used up to then shall be checked and the oil absorption (%) G shall be calculated by the following formula:

$$G = \frac{H}{S} \times 100$$

where,

G: oil absorption (%)

H: amount of linseed oil required (ml)

S: weight of the sample (g).

Oil absorption is expressed herein as ml of oil required per 100 g of sample, the value being equal to the % value calculated by the above formula.

When the pigment is incorporated into the coating layer of the printing sheet, the amount of the pigment to be used can be suitably adjusted according to the kind of materials for the coating layer, the method of forming the coating layer, the conditions of post-treatment and the like. A suitable amount of the pigment is usually in the range of about 10 to about 85% by weight, preferably about 15 to about 75% by weight, based on the total amount of the solids in the coating layer.

Useful adhesives include, for example, starches, hydroxyethyl cellulose, methyl cellulose, carboxymethyl cellulose, gelatin, casein, gum arabic, polyvinyl alcohol, styrene, a salt of a styrene-maleic anhydride copolymer, a styrene-butadiene copolymer emulsion, etc.

When the pigment is not used, the amount of the adhesive to be used is about 2 to about 95% by weight, preferably about 5 to about 90% by weight, based on the total amount of the solids in the coating layer. When the pigment is used, the amount of the adhesive to be used is about 5 to about 75% by weight, preferably about 10 to about 65% by weight, based on the total amount of the solids in the coating layer.

The coating layer may further contain a thermally fusible material to increase the sensitivity of color formation, and a ultraviolet absorber, zinc oxide, titanium dioxide or the like to improve the storage stability.

The printing sheet of the invention can be produced by applying a coating composition comprising the foregoing components to the whole or part of the substrate surface, drying the coated substrate and causing color formation in the whole of the coating layer.

The coating layer may be formed over the whole or a portion of the substrate surface in the printing sheet of the invention. The coating layer is usually colored in its entirety.

Substrates useful in the invention are not specifically limited and can be suitably selected from paper, paper of synthetic fibers, films of synthetic resins, metal substrates, metal foils, glass plates, etc.

The coating composition can be prepared usually by dispersing the basic dye, the color developing material, the adhesive, and optionally the pigment and other components simultaneously or separately with a ball mill, attritor, sand mill or the like using water as a dispersing medium.

Methods for forming the coating layer are not specifically limited and include techniques conventionally carried out using, for example, a bar coater, air knife coater, blade coater, curtain coater or other suitable coaters, or suitable printing machines.

The amount of the coating composition to be applied is not specifically limited insofar as it can form the colored portion in the printing sheet. The amount of the coating composition to be applied is generally about 1 to about 10 $g/m^2$, preferably about 2 to about 8 $g/m^2$, on dry basis.

In producing the printing sheet of the invention, the coating composition is applied to the substrate and the coated substrate is dried at a temperature higher than the temperature at which a color development is initiated until a color is formed over the whole of the coating layer. Alternatively, the coated substrate is dried at a temperature lower than the color development-initiating temperature, followed by heat treatment of the whole of the resulting coating layer, whereby a color is formed over the whole coating layer.

According to another embodiment, a self-contained type pressure-sensitive recording material as disclosed in U.S. Pat. Nos. 4,486,762 and 4,680,597 is prepared by forming a coating composition containing the basic dye and color developing material, one of which is micro-encapsulated, applying the coating composition to the substrate, and drying the coated substrate, and then pressed with a calender or like means to form a color. The disclosures of said U.S. Pat. Nos. are incorporated herein by reference.

Micro-encapsulation can be suitably accomplished by method conventionally used in the production of pressure-sensitive recording materials, such as complex coacervation, simple coacervation, in-situ polymerization, interfacial polymerization or the like.

Prints of human body parts or prints of other objects can be easily produced on the printing sheet thus obtained by bringing the desensitizer present on the surface of the body part or other objects into contact with the colored portion of the printing sheet to decolorize the contacted area due to the ensuing reaction.

The desensitizer for use herein can be any of known desensitizers which are water-soluble. Examples of such desensitizers include glycerin; dodecylamine; 2,4,4-trimethyl-2-oxazoline; N,N-di(polyoxyethylene)ethylamine; polyoxypropylene-diethylamine adducts; polyethyleneimine; polyolefin glycols such as polyethylene glycol, polypropylene glycol and copolymer of ethylene glycol and propylene glycol; cationic surfactants such as dodecyltrimethylammonium chloride, stearylamine acetate or the like; anionic surfactants such as sodium polyoxyethylenealkyl ether sulfate, triethanolamine polyoxyetylenealkyl ether sulfate, sodium polyoxyethylenealkyl phenyl ether sulfate or the like; nonionic surfactants such as polyoxyethylene lauryl ether, polyoxyethylene oleyl ether, polyoxyethylene nonyl phenyl ether, polyoxyethylene sorbitan monolaurate, polyethylene glycol monosterate or the like.

Among these desensitizers, polyolefin glycol having an average molecular weight of about 200 to about 2,000, anionic surfactants and nonionic surfactants are preferred because the use of these desensitizers results in excellent decolorization. The most preferred is the above polyolefin glycol, since it does not cause any harm to the human body.

The desensitizer which is liquid at room temperature can be used as it is or in the form of an aqueous solution. The desensitizer which is solid at room temperature is used in the form of an aqueous solution. When the desensitizer is used in the form of an aqueous solution, the concentration of the desensitizer may vary depending on the kind (including molecular weight) of desensitizer to be used, kind or composition of the coating layer of the printing sheet, kind of the object to be printed and the like, and is not particularly limited. However, it is generally preferable to adjust the concentration to about 5 to about 100 wt.%, particularly about 10 to about 80 wt.% in terms of the solids or liquid nonvolatile substance obtainable upon evaporation of the aqueous solution.

Human body parts or other objects can be imprinted on the printing sheet of the invention by various methods. The objects to be imprinted are not specifically limited insofar as they can be coated with a desensitizer. Examples of such objects are soles, palms, fingertips, articles, fishes, woodcuts, etc. In impressing the body part or other objects on the printing sheet, the surface thereof is coated with a desensitizer, and the desensitizer thereon is contacted with the colored portion of the printing sheet, whereby the colored portion is decolorized in the contacted area thereof, giving a desired print. The amount of the desensitizer for use in this case to obtain the desired print is suitably selected over a wide range and is not particularly limited, and is preferably in the range effective to form a thin film of the desensitizer over the surface of the body part or other objects to be impressed on the printing sheet. Preferably a flexible, porous material such as gauze, nonwoven fabric, woven fabric, sponge or the like is impregnated with the desensitizer or the aqueous solution thereof, and the impregnated porous material is contacted with the body part or other objects to be imprinted to transfer the desensitizer to the surface of the body part or other objects after which the desensitizer present thereon is further transferred to the printing sheet. The amount of the desensitizer or the aqueous solution thereof to be impregnated into the porous material is suitably determined and preferably about 0.5 to about 5 times the weight of the porous material.

When the pigment is incorporated into the coating layer on the printing sheet, the advantage is that the desensitizer is unlikely to remain on the body part or other objects after the desensitizer, transferred from the porous material to the body part or other objects, has been contacted with the coating layer of the printing sheet.

Alternatively, instead of applying the desensitizer directly to the surface of palm, sole or other objects, the desensitizer may be impregnated into a flexible porous material such as gauze, nonwoven fabric, woven fabric, sponge or the like, and then the impregnated porous material is placed on the colored portion of the printing sheet, and the palm, sole or the like is impressed on the impregnated porous material. The amount of the desensitizer to be used in this case is in the range in which the desensitizer can not migrate without application of pressure but can sufficiently migrate to the printing sheet under applied pressure. The amount of the desensitizer or the aqueous solution thereof to be added in this case can be easily determined by those skilled in the art and is preferably in the range of abut 0.5 to about 5 times the weight of the porous material, although depending on the porosity of the porous material, kind of desensitizer, etc.

In any of the foregoing methods, the desensitizer on the object is contacted with the colored portion of the printing sheet under a pressure and for a time period effective to partly or completely remove the color from the contacted area of the coating layer to form a clear print thereon.

According to the invention, there is also provided a kit for taking a print of an object which comprises the printing sheet and a container containing the desensitizer. Containers for use to hold the desensitizer in the invention are not specifically limited and can be any of containers insofar as they can hold the desensitizer. The kit of the invention may further comprise a porous material for impregnation of the desensitizer, such as gauze, nonwoven fabric, woven fabric, sponge, or the like. The porous material may be retained as impregnated with the desensitizer in the container or may be impregnated with the desensitizer immediately before use. In the former case, the porous material is preferably in the form suited for being carried by the container. In the latter case, the porous material is preferably in the form of a sheet or the like.

EXAMPLES

The present invention will be described below in greater detail with reference to the following Examples to which, however, the invention is not limited. The percentages and the parts in the Examples are all by weight unless otherwise specified.

EXAMPLE 1

Preparation of Printing Sheet

| Preparation of Dispersion A | |
|---|---|
| The following components were mixed together: | |
| 3,3-Bis(p-dimethylaminophenyl)- | 10 parts |

-continued

| Preparation of Dispersion A | |
|---|---|
| The following components were mixed together: | |
| 6-diethylaminophthalide | |
| 5% Aqueous solution of methyl cellulose | 5 parts |
| Water | 40 parts |

The mixture thus obtained was treated by a sand mill to pulverize the particles to an average particle size of 3 μm, whereby Dispersion A was produced.

| Preparation of Dispersion B | |
|---|---|
| The following components were mixed together: | |
| Zinc 3,5-di(α-methylbenzyl) salicylate | 20 parts |
| 5% Aqueous solution of methyl cellulose | 5 parts |
| Water | 55 parts |

The mixture thus obtained was treated by a sand mill to pulverize the particles to an average particle size of 3 μm, whereby Dispersion B was produced.

Mixed together were 55 parts of Dispersion A, 80 parts of Dispersion B, 250 parts of a 48% styrene-butadiene copolymer latex and 300 parts of water. The mixture was stirred. The obtained coating composition was applied with a wire bar to double-side clay coated paper weighing 127.9 g/m$^2$ in an amount of 4.5 g/m$^2$ on dry basis. The paper thus coated was dried at a temperature of 110° C. for 1 minute, giving a printing sheet having a blue color.

Taking of Footprint

A gauze piece weighing 50 g/m$^2$ was impregnated with a 50% aqueous solution of polyethylene glycol (average molecular weight 300) in an amount of 50 g/m$^2$. A human adult taking his footprints stepped on the gauze piece with his one bare foot placed thereon. Then, the person with his sole thus wetted with the desensitizer solution stood on the blue printing sheet with his two feet placed thereon for 1 second, whereby the blue color of the printing sheet was decolorized in the contacted area, leaving an impression of the sole in which the impression of the lines on the toes (like fingerprints) were clearly discerned. The same printing procedure was repeated by the same person in the same manner as above with the exception of standing on the printing sheet for 5, 10, 30 or 60 seconds. Each of the resulting impressions of the sole was clear and the impression of the lines on the toes were clearly discerned.

EXAMPLE 2

A black printing sheet was prepared in the same manner as in Example 1 with the exception of using 3-(N-ethyl-N-isoamylamino)-6-methyl-7-phenylaminofluoran in place of 3,3-bis(p-dimethylaminophenyl)-6-diethylaminophthalide used for Dispersion A. A human adult pressed the desensitizer-impregnated gauze piece used in Example 1 with his palm so as to transfer the desensitizer to the palm, and then pressed the printing sheet with the palm placed thereon for 2 seconds. Thereby the black portion of the printing sheet was decorlized in the contacted portion, leaving an impression of the hand in which the lines of the fingerprint were distinctly recognized.

EXAMPLE 3

A desensitizer-impregnated gauze piece was prepared in the same manner as in Example 1 with the exception of using Emulgen 935 (trademark for polyoxyethylene nonylphenyl ether, product of Kao soap Co., Ltd.) in place of polyethylene glycol (average molecular weight 300). The gauze piece was pressed against a sea bream to transfer the desensitizer to the surface of the sea bream. The gauze piece was removed, and then a printing sheet prepared in the same manner as in Example 1 was pressed against the surface of the sea bream coated with the desensitizer. The obtained fish print had distinct impressions of the scales and fins.

EXAMPLE 4

Preparation of Dispersion C 3,3-Bis(p-dimentylaminophenyl)-6-diethylaminophthalide (5 parts) was dissolved in 100 parts of diisopropyl naphthalene with heating to give 105 parts of an oil to be encapsulated. Fifteen parts of polymethylenepolyphenylpolyisocyanate was dissolved in 105 parts of the oil. The solution was added to 600 parts of a 2% aqueous solution of polyvinyl alcohol and the mixture was emulsified to obtain an emulsion in which oil droplets having an average particle size of 8.0 μm were dispersed in the aqueous phase. The obtained system was subjected to a reaction at 80° C. for 4 hours to provide a dispersion containing microcapsules dispersed therein (Dispersion C).

Preparation of Dispersion D

Pulverized by a ball mill for 24 hours was a mixture of 60 parts of zinc oxide, 45 parts of zinc 3,5-di(α-methylbenzyl)salicylate, 15 parts of a 10% aqueous solution of polyvinyl alcohol and 90 parts of water to give a dispersion. Added thereto was 60 parts of a 50% carboxymodified styrene-butadiene copolymer latex to provide a dispersion of color developing material (Dispersion D).

A coating composition was prepared by mixing 100 parts of Dispersion C and 50 parts of Dispersion D. The obtained coating composition was applied with an air knife coater to double-side clay coated paper weighing 127.9 g/m$^2$ in an amount of 7 g/m$^2$ on dry basis. The paper thus coated was subjected to a pressure of 50 kg/cm$^2$ with a super calender, whereby a glue printing sheet was produced.

A human foot was impressed on the printing sheet in the same manner as in Example 1, giving a distinct footprint.

The results obtained hereinbefore reveal the following. When the printing sheets prepared in the preceding Examples, are used, the desired hand prints, footprints, fish prints and prints of other objects can be produced according to the invention without smearing the palm, sole, fish or other objects with a coloring material. Therefore the printing sheet of the invention can be used to achieve the contemplated effects.

EXAMPLE 5

A coating composition as prepared by mixing 55 parts of Dispersion A, 80 parts of Dispersion B, 350 parts of aggregates of fine precipitated calcium carbonate particles (trademark "CALRIGHT SA", with an oil absorption of 60 ml/100 g according to JIS K-5101 (the same applies hereinafter), product of Shiraishi Calcium Co., Ltd.), 250 parts of a 48% styrene-butadiene copolymer latex and 1000 parts of water. The mixture was stirred.

The obtained coating composition was applied with a wire bar to one side of base paper weighing 64 g/m$^2$ in an amount of 3.0 g/m$^2$ on dry basis. The paper thus coated was dried at a temperature of 100° C. for 1 minute, giving a blue printing sheet.

A nonwoven fabric piece weighing 25 g/m$^2$ was impregnated with a 50% aqueous solution of polyethylene glycol (average molecular weight 400) in an amount of 50 g/m$^2$. A human adult taking his footprints stepped on the nonwoven fabric piece with his one bare foot placed thereon. Then, the person with his sole thus wetted with the desensitizer solution stood on the above blue printing sheet with his two feet placed thereon for 1, 5, 10, 30 or 60 seconds, whereby the blue color of the printing sheet was decorized in the contacted portion in each case, leaving an impression of the sole. In each case, the desensitizer solution did not remain on the sole.

Since the degree of disagreeable feeling depends on individuals' sensitivity, the following test was conducted in this Example and the Examples that follow. After impression on the printing sheet, the sole was impressed on uncoated wood-free paper to determine the presence or absence of the desensitizer solution transferred to the paper by visual inspection. When the solution was not found to remain on the paper, the solution was regarded as absent on the sole, that is, disagreeable feeling was recognized as nonexistent.

EXAMPLE 6

A printing sheet was prepared in the same manner as in Example 5 with the exception of using 150 parts of silicon dioxide pigment (with an oil absorption of 180 ml/100 g) in place of 350 parts of aggregates of precipitated calcium carbonate particles (with an oil adsorption of 60 ml/100 g). A human foot was impressed on the printing sheet in the same manner as in Example 5, whereby a clear footprint was produced as a result of decolorization of the contacted portion of the printing sheet. The polyethylene glycol solution did not remain on the sole.

EXAMPLE 7

| Preparation of Dispersion A' | |
|---|---|
| The following components were mixed together: | |
| 3,3-Bis(p-dimethylaminophenyl)-6-diethylaminophthalide | 10 parts |
| 1,2-Bis(3-methylphenoxy)ethane | 20 parts |
| 5% Aqueous solution of methyl cellulose | 5 parts |
| Water | 55 parts |

The mixture thus obtained was treated by a sand mill to pulverize the particles to an average particle size of 3 μm, whereby Dispersion A' was produced.

Mixed together were 90 parts of Dispersion A', 80 parts of Dispersion B, 350 parts of a pigment in the form of aggregates of precipitated calcium carbonate particles (with an oil absorption of 60 ml/100 g), 250 parts of a 48% styrene-butadiene copolymer latex and 1000 parts of water. The mixture was stirred.

The obtained coating composition was applied with a wire bar to one side of base paper weighing 64 g/m$^2$ in an amount of 3.0 g/m$^2$ on dry basis. The paper thus coated was dried at a temperature of 90° C. for 1 minute, giving a blue printing sheet.

A human foot was impressed on the printing sheet in the same manner as in Example 5 with the exception of using a 35% aqueous solution of polyethylene glycol (average molecular weight 1500) in place of the 50% aqueous solution of polyethylene glycol (average molecular weight 400), whereby a clear footprint was produced upon removal of the color from the colored portion of the printing sheet. The polyethylene glycol solution did not remain on the sole.

EXAMPLE 8

A blue printing sheet was prepared in the same manner as in Example 5 with the exception of using precipitated calcium carbonate pigment (with an oil absorption of 30 ml/100 g) in place of the aggregates of precipitated calcium carbonate particles (with an oil absorption of 60 ml/100 g).

A human foot was impressed on the printing sheet in the same manner as in Example 5, producing a clear footprint as a result of decolorization of the contacted portion of the printing sheet. Only a small amount of the polyethylene glycol solution was found on the sole.

According to the present invention, hand prints, footprints, fish prints and prints of other objects can be produced without smearing the hand, foot or objects with a coloring material. Moreover, when a human body part is impressed on the printing sheet of the invention, substantially no desensitizer remains on the body part after imprinting. Therefore the printing sheet of the invention is very useful to accomplish the contemplated effects.

I claim:

1. A method for taking a print of an object, the method comprising the steps of applying a desensitizer to the object and bringing the applied desensitizer into contact with a colored portion of a sheet, the sheet comprising:

(a) a substrate, and (b) a coating layer formed over the whole surface or part of the surface of the substrate and comprising a colorless or pale-colored basic dye, a color developing material which develops a color on contact with the dye and an adhesive, the whole of the coating layer being colored by the color-forming reaction of the basic dye and the color developing material.

2. A method according to claim 1 wherein the coating layer further contains a pigment which is least 50 ml/100 g in the oil absorption as defined in JIS K-5101.

3. A method according to claim 1 wherein the desensitizer is at least one compound selected from polyolefin glycol, anionic surfactant, nonionic surfactant and polyethyleneimine.

4. A method according to claim 1 wherein the desensitizer is a polyolefin glycol having an average molecular weight of about 200 to about 2,000.

5. A method according to claim 1 wherein the desensitizer is an anionic surfactant selected from the group consisting of sodium polyoxyethylenealkyl ether sulfate, triethanolamine polyoxyethylenealkyl ether sulfate and sodium polyoxyethylenealkyl phenyl ether sulfate.

6. A method according to claim 1 wherein the desensitizer is a nonionic surfactant selected from the group consisting of polyoxyethylene lauryl ether, polyoxyethylene oleyl ether, polyoxyethylene nonyl phenol ether, polyoxyethylene sorbitan monolaurate and polyethylene glycol monostearate.

* * * * *